US007686236B2

(12) United States Patent
Alexander

(10) Patent No.: US 7,686,236 B2
(45) Date of Patent: Mar. 30, 2010

(54) STEM ROTATION CONTROL FOR A SPRINKLER AND METHODS THEREFOR

(75) Inventor: Mona-Lisa Alexander, San Marino, CA (US)

(73) Assignee: Rain Bird Corporation, Azusa, CA (US)

( * ) Notice: Subject to any disclaimer, the term of this patent is extended or adjusted under 35 U.S.C. 154(b) by 74 days.

(21) Appl. No.: 11/689,135

(22) Filed: Mar. 21, 2007

(65) Prior Publication Data

US 2008/0230628 A1 Sep. 25, 2008

(51) Int. Cl.
*B05B 3/00* (2006.01)
*B05B 3/04* (2006.01)
*B05B 15/10* (2006.01)

(52) U.S. Cl. ..... 239/206; 239/203; 239/204; 239/237; 239/264

(58) Field of Classification Search ..... 239/200, 239/201, 203–206, 225.1, 237, 241–242, 239/264, DIG. 1
See application file for complete search history.

(56) References Cited

U.S. PATENT DOCUMENTS 3,268,173 A 8/1966 Costa
4,681,259 A 7/1987 Troup et al.
4,787,558 A 11/1988 Sexton et al.
5,086,977 A * 2/1992 Kah, Jr. ..... 239/205
5,383,600 A 1/1995 Verbera et al.
6,530,531 B2 * 3/2003 Butler ..... 239/205
6,997,393 B1 2/2006 Angold et al.
2002/0092924 A1 7/2002 Ingham, Jr. et al.
2003/0006307 A1 * 1/2003 Clark ..... 239/242
2004/0195362 A1 10/2004 Walker
2005/0194464 A1 * 9/2005 Bruninga ..... 239/200
2006/0108444 A1 5/2006 Yeh et al.
2006/0108446 A1 5/2006 Yeh et al.
2007/0007364 A1 1/2007 Gregory
2007/0029404 A1 2/2007 Markley et al.

* cited by examiner

*Primary Examiner*—Darren W Gorman
(74) *Attorney, Agent, or Firm*—Fitch, Even, Tabin & Flannery

(57) ABSTRACT

A sprinkler includes a stationary portion configured for connection to a fluid source and a head with an outlet for emitting fluid. A stem supports the head and is configured for translating along a longitudinal axis and for rotating about the longitudinal axis. At least one retainer is disposed between the stationary portion and the stem. The retainer is configured for permitting the stem to rotate about the longitudinal axis relative to the stationary portion when a rotational force applied to the stem exceeds a predetermined amount.

29 Claims, 11 Drawing Sheets

100

106
102
104

STEM ROTATION CONTROL FOR A SPRINKLER AND METHODS THEREFOR

FIELD OF THE INVENTION

The invention relates to a sprinkler and, more particularly, to a mechanism that controls the rotation of a stem holding a sprinkler head.

BACKGROUND OF THE INVENTION

Pop-up irrigation sprinklers are typically buried in the ground and include a stationary housing and a riser assembly mounted within the housing and that shifts up and down in the housing. During an irrigation cycle, the riser assembly is propelled through an open upper end of the housing and projects above ground level, or "pops up," to distribute water to surrounding terrain. More specifically, pressurized water is supplied to the sprinkler through a water supply line attached to an inlet of the housing. The pressurized water causes the riser assembly to travel upwards against the bias of a spring to the elevated spraying position above the sprinkler housing to distribute water to surrounding terrain through one or more spray nozzles. When the irrigation cycle is completed, the pressurized water supply is shut off and the riser is spring-retracted back into the sprinkler housing so that the housing and riser assembly are again at and below ground level.

The riser assembly commonly includes a sprinkler head mounted at the upper end of a stem. The sprinkler head has one or more outlets or spray nozzles and may or may not be rotatable on the stem. Rotary type sprinklers have a sprinkler head that rotates on the stem, commonly referred to as a turret. The head rotates through an adjustable arcuate water distribution pattern called a spray arc. These rotary sprinklers may include a water-driven motor to transfer energy of the incoming water into a source of power to rotate the turret. One common mechanism uses a water-driven turbine and a gear reduction system to convert the high speed rotation of the turbine into relatively low speed turret rotation.

During normal operation, the turret rotates to distribute water outwardly over surrounding terrain within the spray arc which is set by setting the end limits of rotation of the turret relative to the stem. Rotary sprinklers commonly employ an arc adjustment mechanism, where one edge of the spray arc (the start angle, for example) is fixed relative to the stem that the turret sits upon and the other edge (the end angle, for example) of the spray arc is adjustable to set the arcuate length or included angle of the spray arc.

For known sprinklers with rotatable turrets, the stem does not rotate relative to the housing during operation, that is while the turret is rotating on the stem, so that the angular direction of the spray arc can be fixed to spray over a desired area around the sprinkler. Thus, the bottom of the stem typically has a ring of outwardly-extending teeth that engage ribs extending longitudinally along an inner surface of the housing to restrict rotation of the stem relative to the housing. With this configuration, in order to change the fixed edge of the spray arc, the sprinkler must be disassembled. More specifically, for example, the stem and turret are removed from the sprinkler housing, rotated to point the outlet or other mark on the turret that defines the fixed edge of the spray arc in a desired direction, and then placed back into the housing. Other non-rotating sprinklers without rotating turrets also require the same disassembly where the outlet on the sprinkler must be pointed in a desired direction before the stem is placed back into the housing.

Also, if the user or a vandal rotates the stem in the housing, the ring, gear teeth, and/or ribs on the housing can break, leaving the stem to rotate freely. When this occurs, the outlet may shift to a different rotational position every time pressurized water pops up the stem for watering, resulting in watering undesired areas, while missing the desired area. For rotary sprinklers, the rotation of the turret also can cause undesired rotation of the free, broken stem during operation that rotates the entire spray arc set for the sprinkler so that the sprinkler is not watering the desired area.

At least for non-rotary sprinklers that receive relatively low water pressure, one attempt at a solution is provided by securing a separate ratchet ring near the bottom of the stem. The ring has outwardly extending protrusions to engage the ribs of the housing so that the ring does not rotate. The ring also has inwardly extending teeth to mesh with teeth on the stem. So configured, applying a very large rotational force on the stem will rotate the stem relative to the housing without breaking the stem, housing or ratchet ring. Thus, the ring restricts rotation of the stem during operation of the sprinkler but permits the stem to rotate to set the position of the outlet or to prevent vandals from damaging the sprinkler.

Even with the ring, however, it is still difficult to rotate the stem because the known ring configuration requires the application of a relatively large rotational force on the stem to overcome the strong forces acting on the stem. This occurs because the teeth on the ring must shift or flex out of engagement with teeth on the stem in order to rotate the stem. Thus, the ring may shift or flex upward or downward off of the stem teeth or shift radially outward from the stem teeth to provide clearance for the stem to rotate. However, the ring and its teeth are sandwiched between an end of the spring and a ledge on the bottom end of the stem. The ring is typically in this position so that the ring can remain with the lower end of the stem while the stem moves up and down due to the biasing force from the spring and/or water pressure. This results in both the biasing force of the spring (from above the ring) and the forces from the water pressure (from the ledge below the ring) applying pressure against the ring making it extremely difficult for the ring to shift or flex away from the teeth on the stem. Additionally, the spring may also bind radially against the stem further increasing the rotational force needed to rotate the stem. It becomes practically impossible to apply such a strong rotational force to the stem when a person has difficulty grasping the stem due to its small diameter. The rotational force that is required is so strong that it can break the teeth on the stem or the ring. For these reasons, this configuration also would not work on rotary sprinklers that typically have higher water pressures than the non-rotary sprinklers.

Accordingly, there has been a need for an improved sprinkler with a stem that does not rotate during normal operation but will otherwise rotate easily when desired to control the watering range.

DESCRIPTION OF THE PREFERRED EMBODIMENTS

Figure 1:
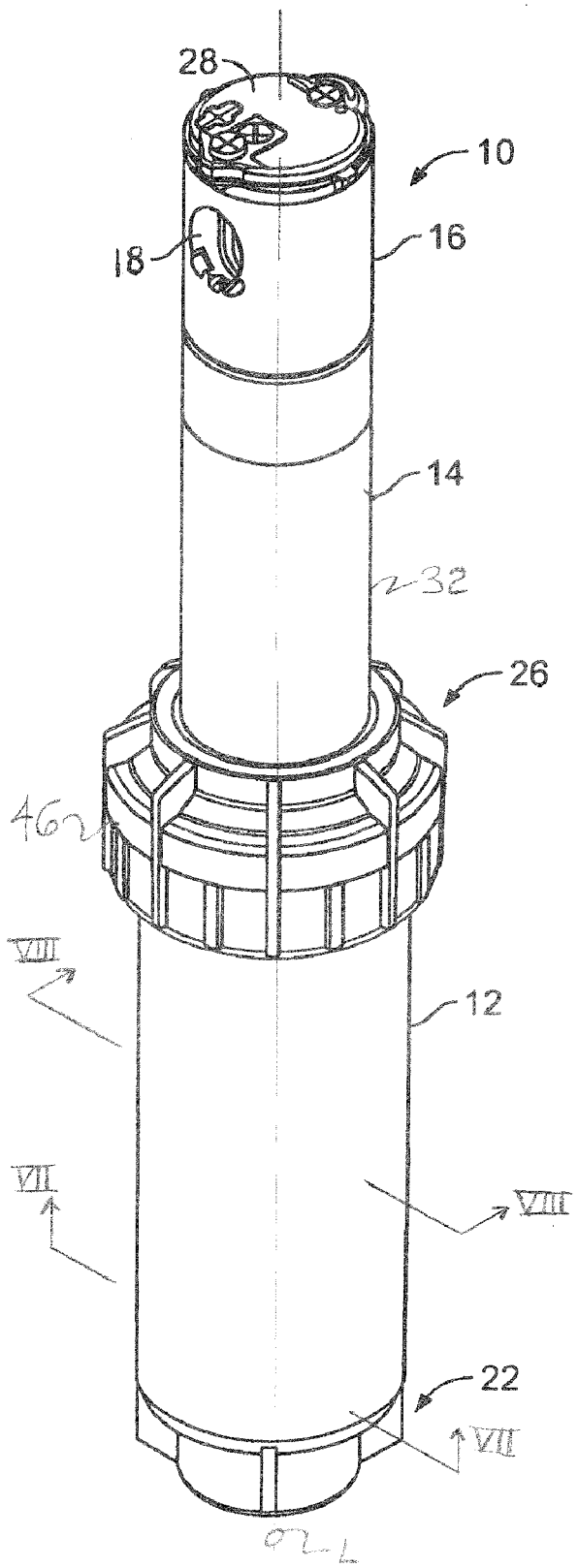
FIG. 1 is a side perspective view of a sprinkler embodying features in accordance with the present invention and shown in an extended configuration.
Figure 2A:
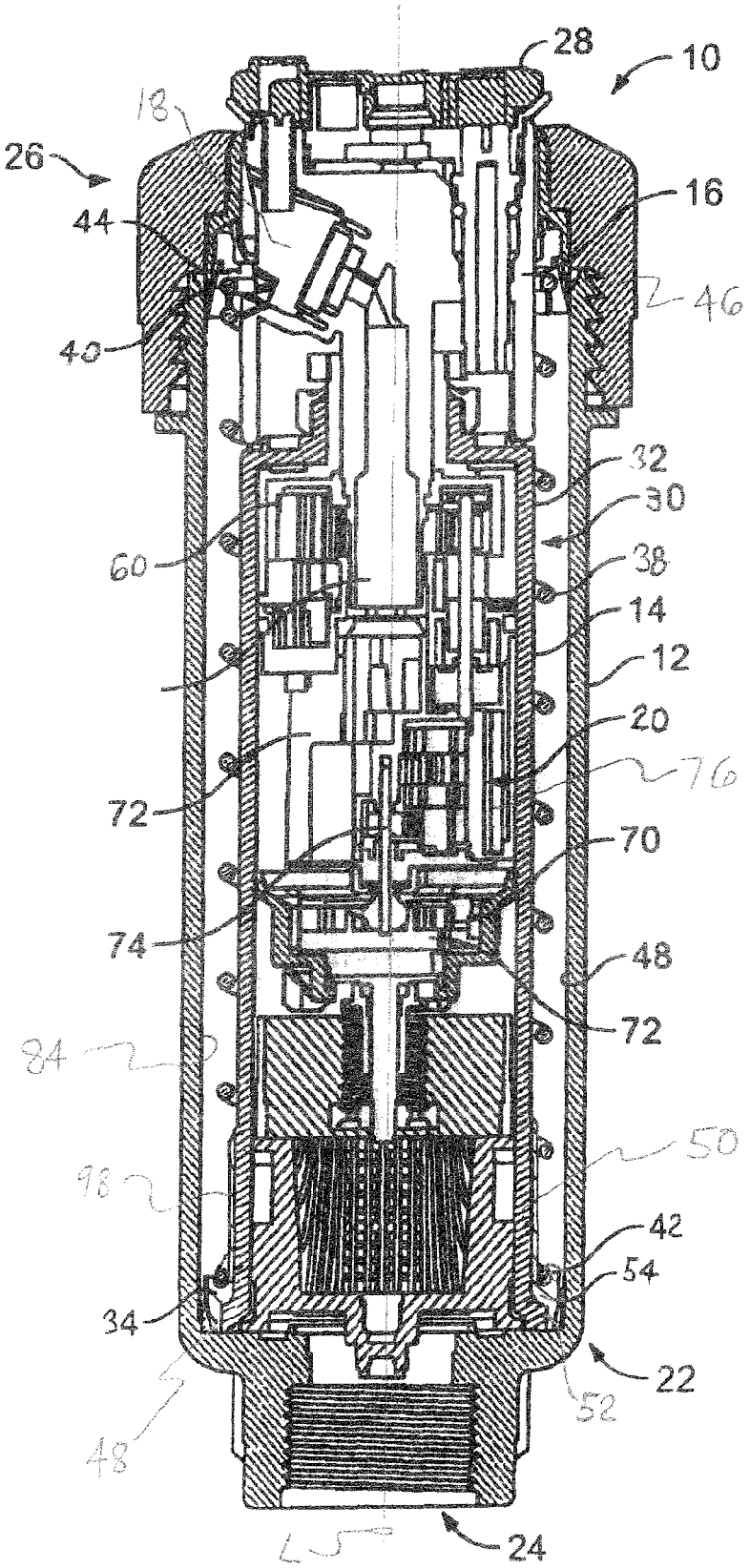
FIG. 2A is a cross-sectional side-view of the sprinkler of FIG. 1 and shown in a retracted configuration.
Figure 2B:
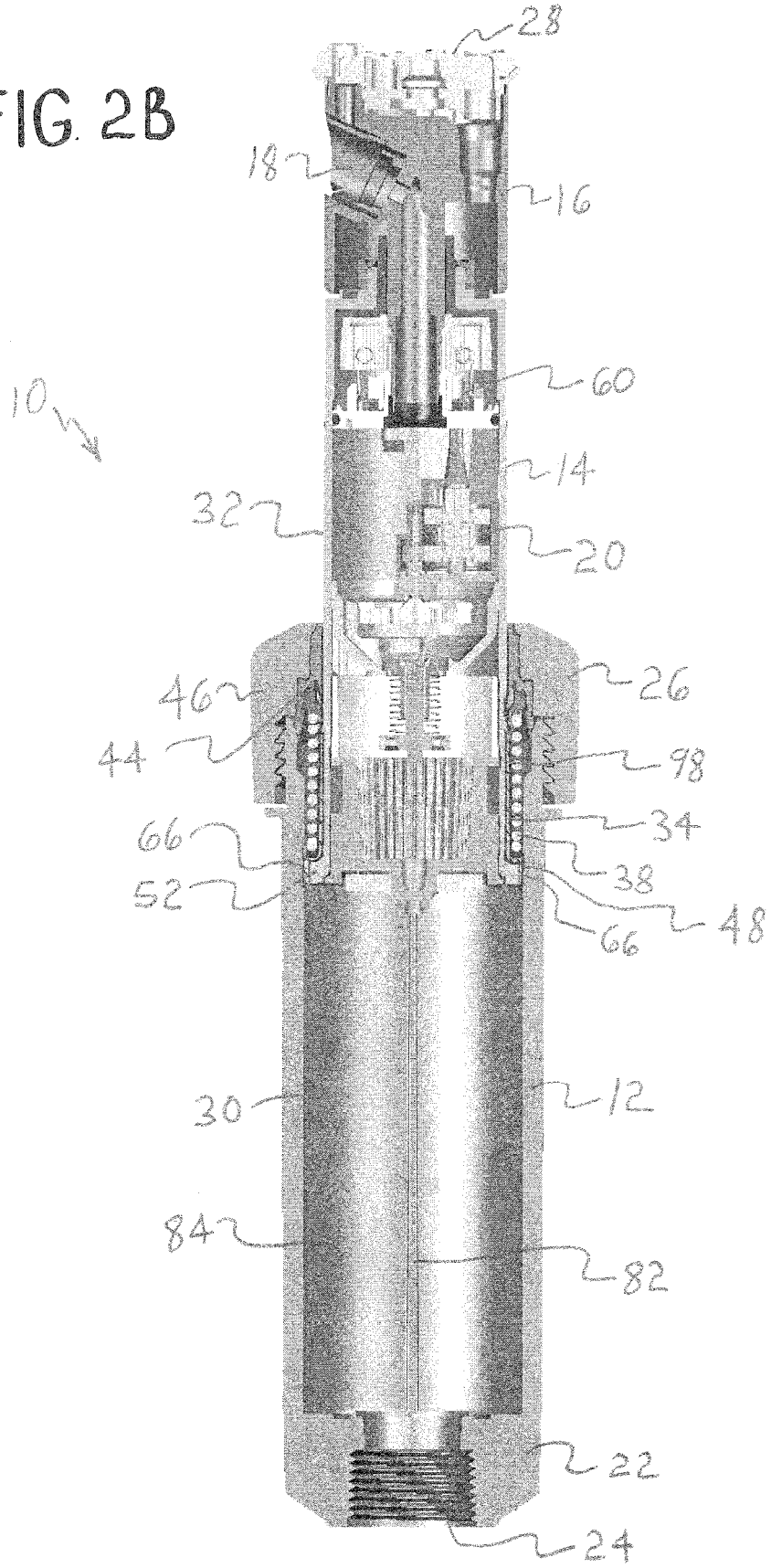
FIG. 2B is a cross-sectional side-view of the sprinkler of FIG. 1 and shown in an extended configuration.
Figure 3:
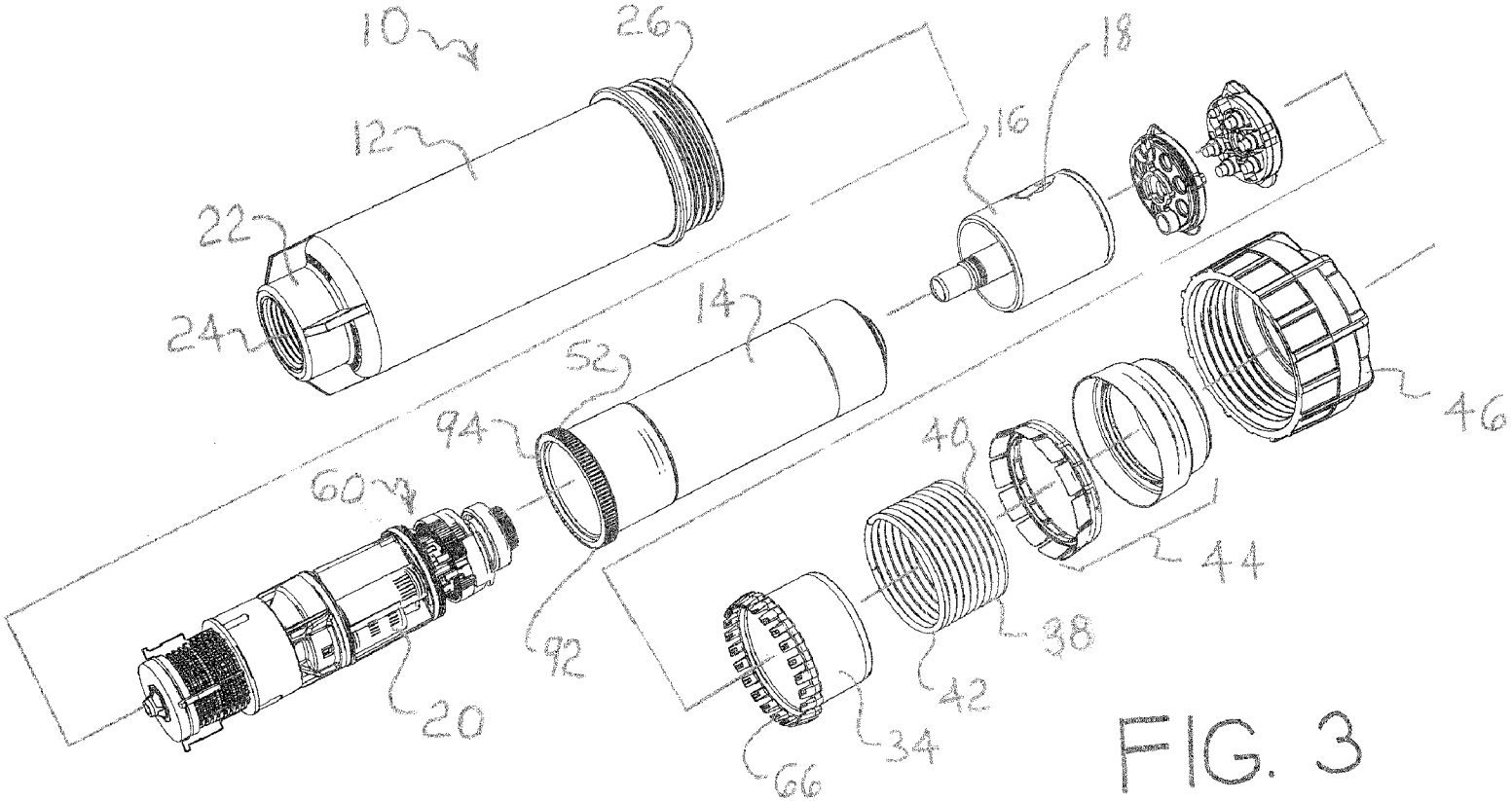
FIG. 3 is an exploded perspective view of the sprinkler of FIG. 1.

Referring to FIGS. 1-3, a pop-up type sprinkler 10 is depicted having a housing 12, a stem 14 mounted to the housing 12, and a rotating sprinkler turret or head 16 mounted on the stem 14. A motor assembly 20 (shown in FIG. 2) is disposed inside the stem 14, and the sprinkler head 16 has a nozzle 18 for emitting fluid as the motor assembly 20 rotates the head 16 relative to the housing 12 and the stem 14.

The housing 12 is stationary at least relative to the stem 14 and may extend into the ground or soil to connect to a water supply line. More specifically, the housing 12 has a lower end 22 defining an inlet 24 that is internally threaded to receive and connect to an externally threaded coupling extension from a pipe for delivering water to the sprinkler 10 from a water source. The sprinkler 10 may be one of a number of sprinklers 10 connected to an irrigation network for distributing water over a particular area.

The housing 12 has an upper end 26, and the sprinkler 10 is installed so that the upper end 26 is generally at or just above grade level. The sprinkler 10 has an extended position, as shown in FIGS. 1 and 2B, and a retracted position, as shown in FIG. 2A. When the water is shut off, a spring 38 biases the stem 14 and the sprinkler head 16 to the retracted position so that they are generally located within the housing 12. In the retracted position, a top surface 28 of the sprinkler head 16 is generally at or just above the ground level.

The housing 12 has a generally cylindrical configuration and defines a central longitudinal axis L and a cavity 30 therein. The stem 14 has a generally cylindrical outer surface 32 such that it can telescopically translate between the extended and retracted positions along the longitudinal axis L relative to the housing 12. As explained further herein, the sprinkler 10 includes a retainer 34 to permit selective rotation of the stem 14 relative to the housing 12 about the longitudinal axis. This enables an edge of the arcuate spray pattern to be adjusted without damaging the sprinkler and aids to prevent damage to the sprinkler by vandals as explained in greater detail below.

The retainer 34 is disposed between the housing 12 and the stem 14, and enables the stem 14 to rotate about the longitudinal axis L and relative to the housing 12 when a rotational force applied to the stem 14 exceeds a predetermined amount. Otherwise, the retainer 34 limits rotation of the stem 14 during normal operation to maintain a spray arc 36 (e.g., FIG. 9) over a desired area to be watered.

More specifically, the spring 38, such as a coil spring, extends along the stem 14 and operates between the bottom of the stem 14 and the top of the housing 12 to bias the stem 14 and associated head 16 to the retracted position in the housing 12. The spring 38 has an upper end 40 that remains stationary relative to the housing 12 and a lower end 42 that engages the retainer 34 and moves with the lower end of the stem 14. The upper end 40 of the spring preferably engages a bracing ring or rings 44 that are disposed underneath a cap 46 that is threaded to the upper end 26 of the housing 12.

The stem 14 has a lower end portion 50 terminating with an annular flange 52 that extends radially a sufficient amount to support the retainer 34 and receive the biasing force of the spring 38 through the retainer 34. The flange 52 has an annular shoulder generally extending radially outward from the cylindrical outer surface 32 of the stem 14 to support the retainer 34. The flange 52 may have many other forms, such as one or more arcuate portions that are less than a full ring or other non-annular forms such as spokes, to name a few examples, as long as at least the structure is sufficient to support the retainer 34.

Referring to FIGS. 2A-5, the retainer 34 is generally cylindrical and is mounted on the lower end 50 of the stem 14. The retainer 34 has a base portion 54 that sits upon the flange 52 and has an upper surface 56 defining an annular groove 58 for receiving the lower end 42 of the spring 38. With this configuration, the base portion 54 of the retainer 34 is sandwiched between the spring 38 and the flange 52 so that the axial biasing force of the spring 38 is transmitted through the retainer 34 to the flange 52 to drive the stem 14 to the retracted position. In this configuration, the spring 38 also maintains the retainer 34 in a fixed engagement with the flange 52 as the stem 14 shifts up and down due to sufficient water pressure when the water supply to the sprinkler 10 is activated or the biasing force of the spring 38 when the water supply to the sprinkler 10 is deactivated.

With reference to FIG. 2B, pressurized water in the housing 12 causes the stem 14 to extend from the housing 12. When the stem 14 is extended, the sprinkler head 16 and the nozzle 18 are elevated above the ground, and water is expelled in the direction nozzle 18 is pointed. The upward shifting of the stem 14 compresses the spring 38 between the brace ring 44 and the retainer 34. When the water supply is shut off, the spring 38 drives the stem 14 into the housing 12 to return it to the retracted position as shown in FIG. 2A.

With the stem 14 in the extended position, water flows through the stem 14 and drives the motor assembly 20 to rotate the sprinkler head 16. The water strikes a turbine 70 located in a water passage 72 and connected to an axle 74 of a series of reduction gears of a gear assembly 76 of the motor assembly 20. The gear assembly 76 converts the relatively high rotational speed of the turbine to a slower higher torque drive for rotating the sprinkler head 16. In this manner, the motor assembly 20 converts the energy and force of the water striking the turbine 70 into rotational force and torque for rotating the sprinkler head.

The motor assembly 20 also has a gear transmission 60 interconnecting the gear assembly with the head 16. The gear transmission is adjustable to set the limits of the spray arc 36. Such a gear transmission is described in detail in commonly owned U.S. Pat. No. 5,383,600, which is incorporated herein by reference, in its entirety. For the purposes of this application, it is sufficient to mention that the gear transmission 60 includes a first tab (not shown) on the head 16 and that rotates with the head (i.e., the first tab is rotationally fixed relative to the rotating outlet 18). The first tab hits a trip lever at a left-rotational position when the head 16 rotates in a counterclockwise direction. When the trip arm is tripped by the first tab, it reverses the direction of rotation of the head 16. The trip lever is mounted on a plate or base interconnected to the stem in a fixed manner. Thus, the position of the trip lever where it engages the first tab is considered a fixed position or location relative to the stem 14 (at least during normal operation of the sprinkler). So configured, the trip lever defines a fixed, left edge 62 (shown in FIG. 9) of the spray arc 36 relative to the stem 14.

Similarly, the trip arm has a right-rotational position where it engages a second tab when the head 16 rotates clockwise. The second tab extends from a rotatable cup on the head 16 that is connected to an adjustment screw accessible at the top 28 of the head 16. This allows the length of the arc or the included angle between the first and second tabs to be adjusted to set the position of the right or opposite edge 64 of the spray arc 36. For purposes of this application, the configuration of the gear transmission 60 is not to be limited other than forming a fixed edge of a spray arc relative to the stem. Thus, for example, the tabs may be switched such that the fixed edge is on the right of the spray arc 36 rather than the left of the spray arc (as viewed from the sprinkler).

The sprinkler 10 also may be provided with a slip clutch feature also described in commonly owned U.S. Pat. No. 5,383,600 (which is incorporated by reference herein in its entirety) so that the head 16 and the entire motor assembly 20, including the gear transmission 60, can rotate about the longitudinal axis L and relative to the stem 14. This prevents damage to the sprinkler if a person grasps and rotates the head 16 with a relatively strong force. Similarly, commonly owned U.S. Patent Publication No. 2006/0108446 (which is incorporated by reference herein in its entirety) describes a slip gear located in the hubs of the gears of the motor assembly 20 so that rotation of the head 16 by a person grasping the head does not necessarily rotate the gears of the motor assembly 20. In either case, these mechanisms do not change the fact that the edge 62 of the spray arc 36 is fixed relative to the stem 14 during normal operation of the sprinkler 10.

One way to adjust the angular position of the fixed edge 62 is to rotate the stem 14 to move the left-side position of the trip arm and, therefore, the left edge 62. As mentioned above, however, the stem 14 should not rotate during normal operation of the sprinkler so that only the head 16 rotates on the stem 14. Otherwise, the edges 62 and 64 defining the spray arc 36 will shift with the stem 14 and will cause the spray arc 36 to move to an undesired area of terrain surrounding the sprinkler 10. To address this situation, the retainer 34 includes a resilient portion 48 to engage the stem 14 to control rotation of the stem 14.

Figure 4:
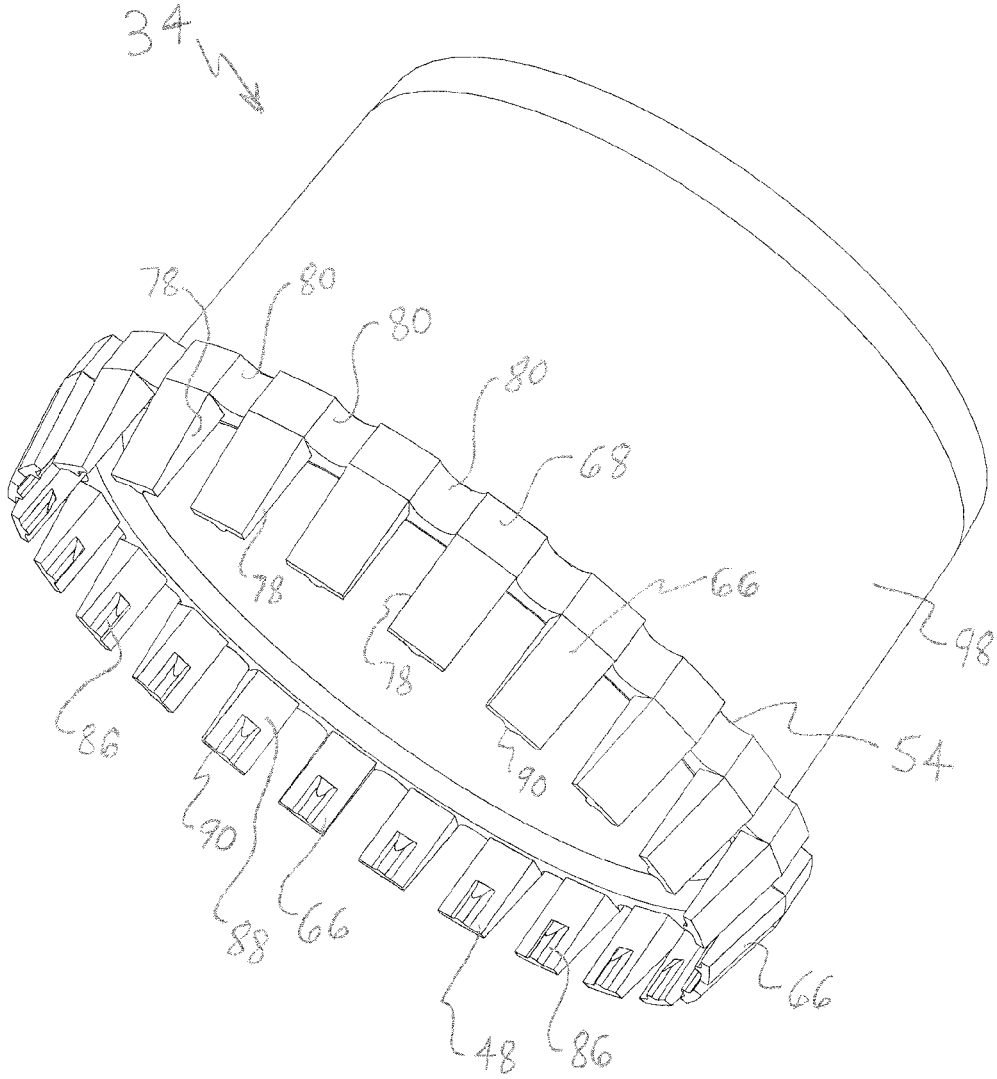
FIG. 4 is a side perspective view of a retainer used in the sprinkler of FIG. 1.
Figure 5:
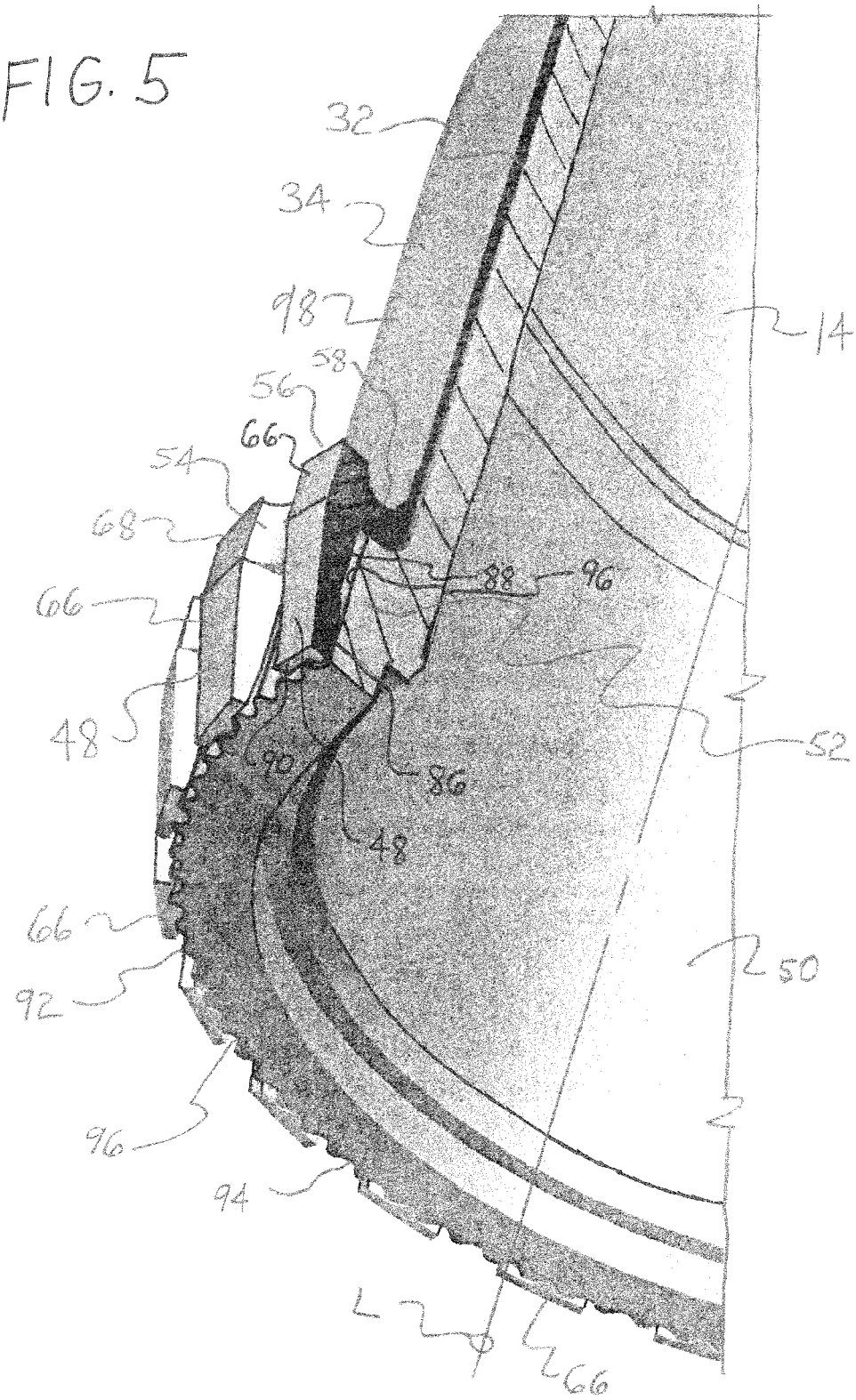
FIG. 5 is a fragmentary, cross-sectional view of the retainer of FIG. 4 mounted on the lower end of a stem of the sprinkler of FIG. 1.
Figure 6:
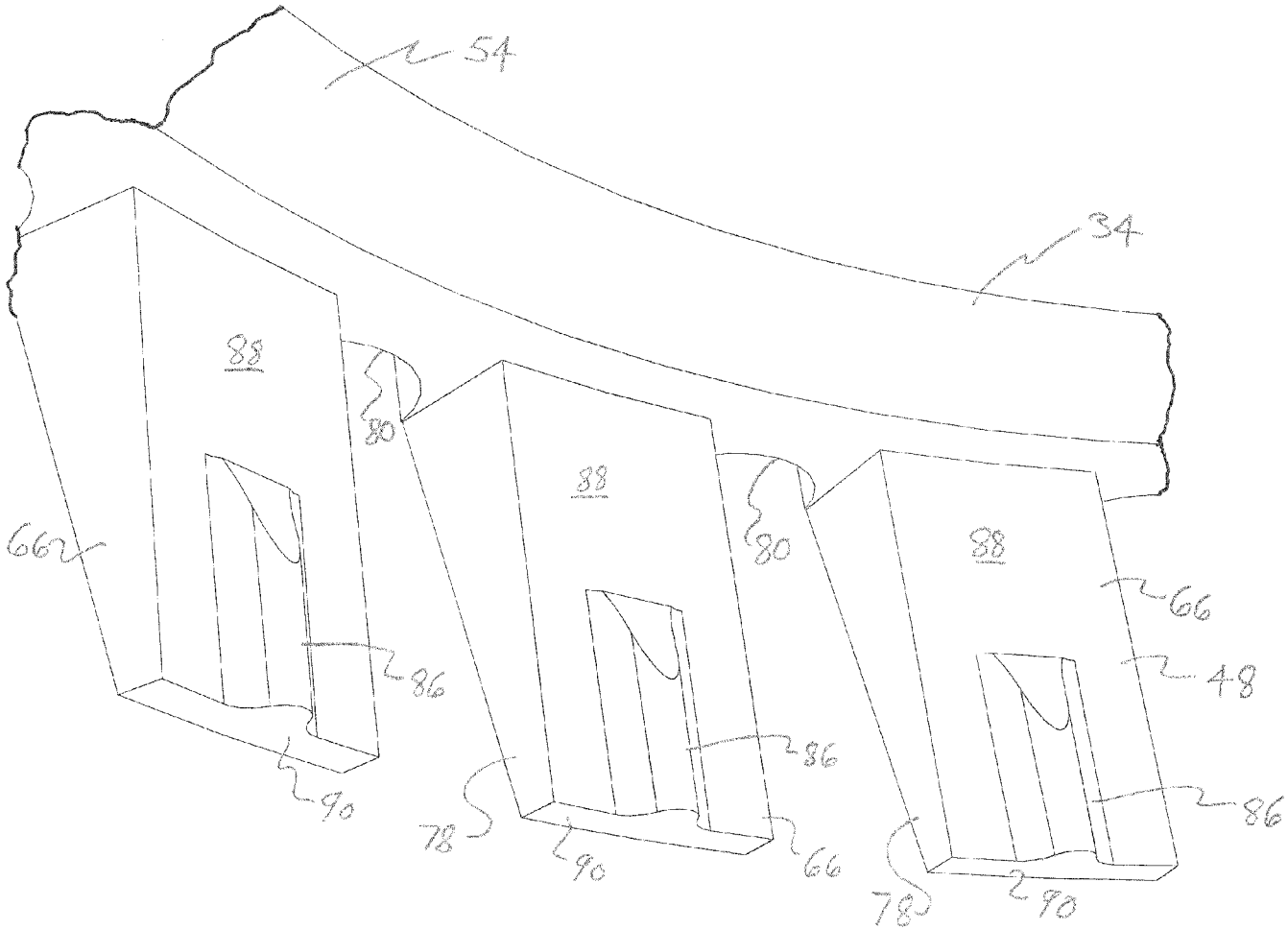
FIG. 6 is a close-up, interior, perspective view of a portion of the retainer of FIG. 4.

With reference to FIGS. 4-5, the resilient portion 48 includes a plurality of fingers 66 extending from a periphery 68 of the base portion 54 of the retainer 34 and generally longitudinally relative to the longitudinal axis L. The fingers 66 are uniformly disposed around the base portion 54 so that each adjacent pair of fingers forms a void 78 therebetween. The voids 78 enable the finger 66 to be flexible. More specifically, each finger 66 has a terminal, free end 90 that is able to move toward and away from the longitudinal axis as the stem 14 is being manually rotated to set, for example, the left edge 62 of the spray arc 36.

Figure 7:
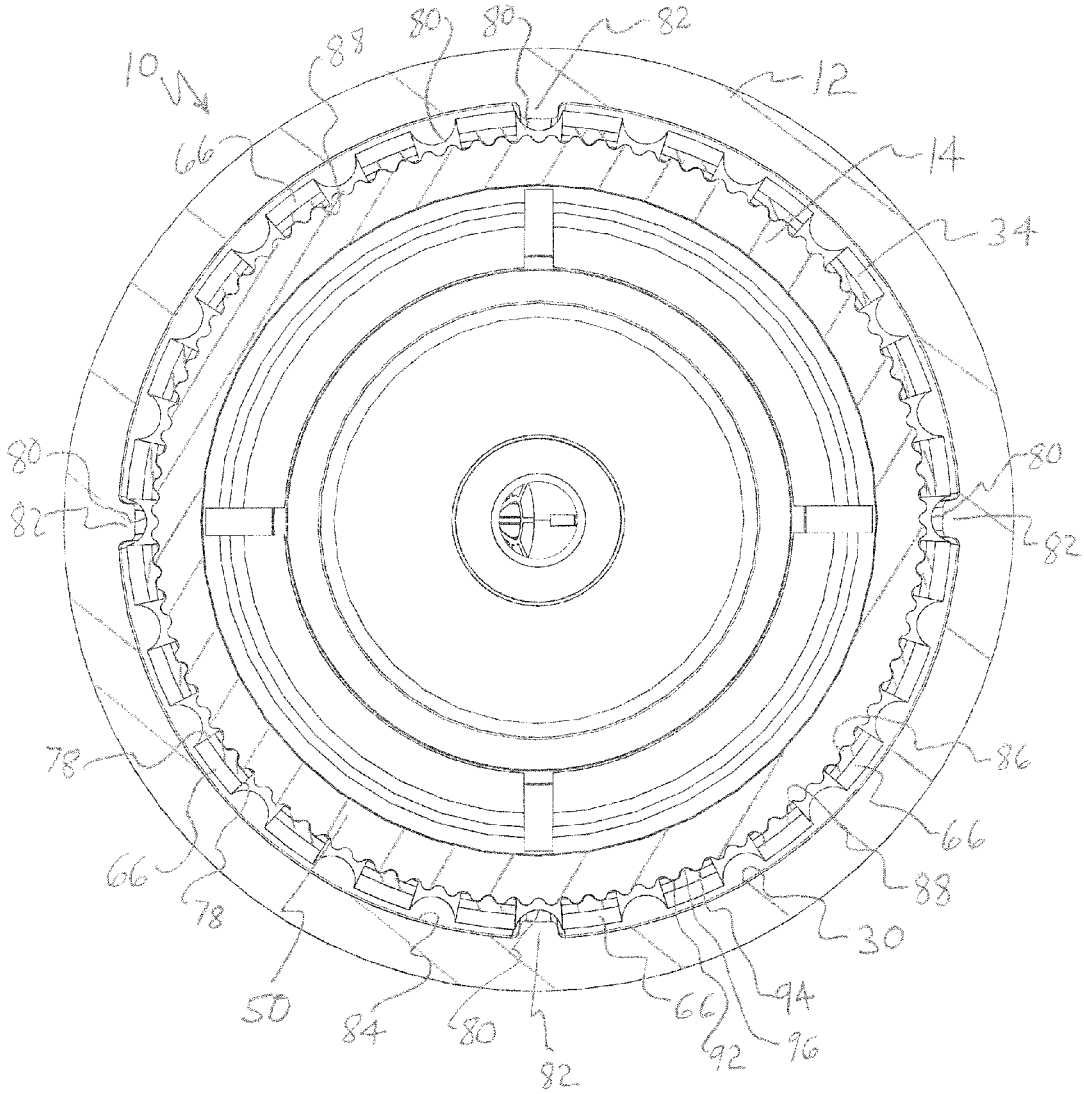
FIG. 7 is a bottom, cross-sectional view taken along line VII-VII of FIG. 1.
Figure 8:
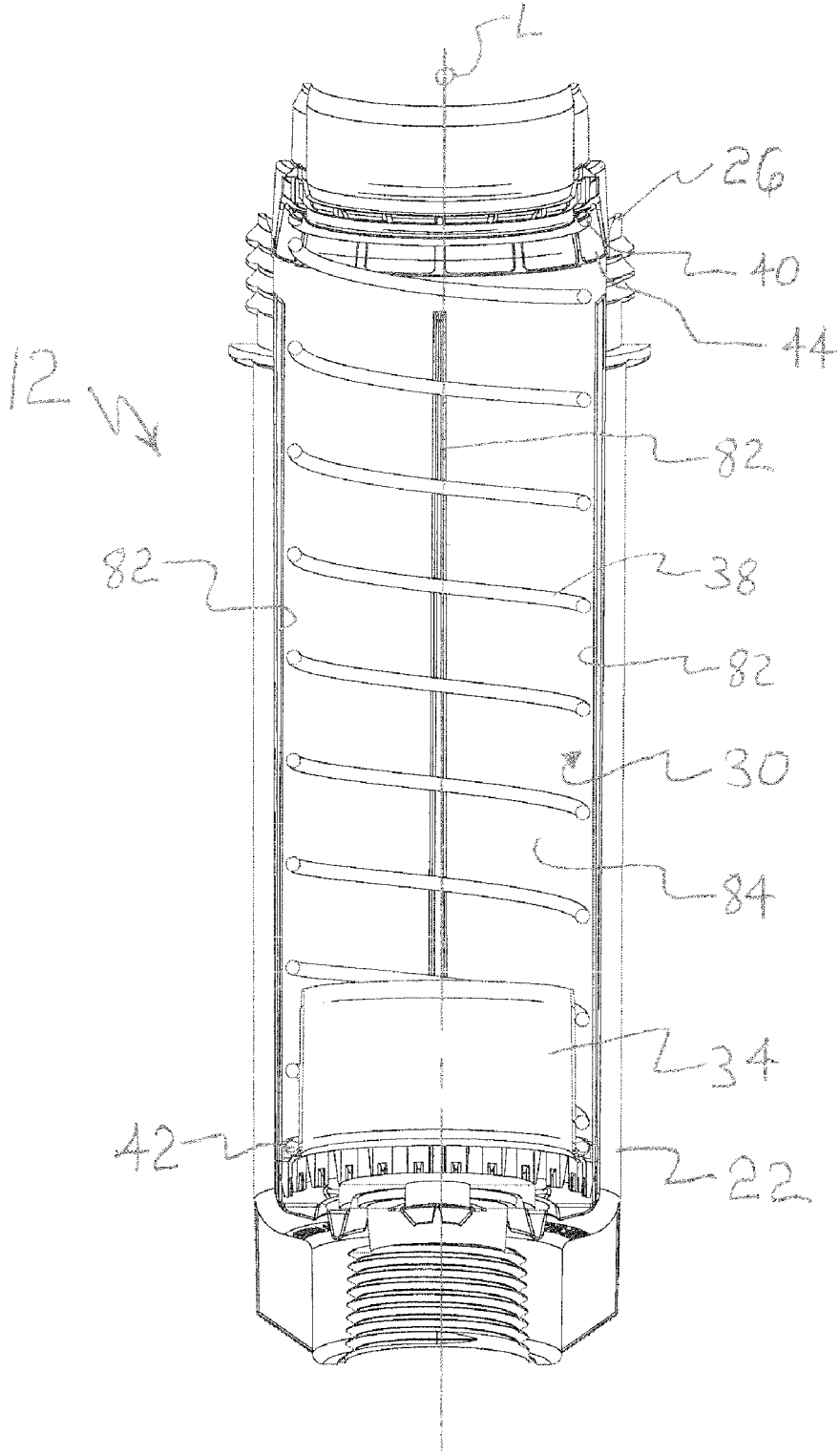
FIG. 8 is a side, cross-sectional view taken along line VIII-VIII of FIG. 1 but with the stem components removed.

Each void 78 aligns generally longitudinally with a groove 80 formed at the periphery 68 of the base portion 54. The aligned grooves 80 and the voids 78 receive a longitudinally extending rib or rail 82 (shown in FIG. 8) extending along an inner surface 84 of the housing 12. For example, there may be four ribs 82 that are uniformly spaced at 90 degree intervals around the housing 12, as shown on FIG. 7. The fingers 66 and ribs 82 are sized to permit the retainer 34 to slide axially along the ribs 82 but the ribs 82 and the grooves 80 have a sufficiently deep engagement to restrict rotation of the retainer 34 relative to the housing 12 during normal use of the sprinkler 10.

As an alternative, the fingers 66 may not be disposed the entire way around the retainer 34 and may be positioned generally around the retainer and stem at particular angular locations, such as at every 90 degrees or 180 degrees. In addition, the retainer 34 may only have as few as a single finger 66.

The fingers 66 each have a short rib 86 that extends longitudinally on an inner surface 88 of the fingers 66 to the free end 90 of the finger 66. Each short rib 86 also extends radially toward the longitudinal axis L and the stem 14, and has a curved exterior surface. The stem 14 has a plurality of teeth 92 on an annular outer surface 94 on the shoulder 52. Each adjacent pair of teeth 92 form a groove 96 therebetween for receiving one of the short ribs 86. Each tooth 92 defines a discrete angular position of rotation for the stem 14 about the longitudinal axis L and relative to the retainer 34 and the housing 12. For example, the stem can be rotated in very minor angular increments, such as small as 3.75°, to set the left edge of the spray arc 36.

The fingers 66 are able to flex away from the longitudinal axis L and the stem 14 to move the short ribs 86 in and out of the grooves 96. That is, the curved exterior surface of the short ribs 86 cam in and out of the grooves 96 by sliding over the curved surface of the teeth 96. Thus, when a rotational force is applied to the stem 14 that exceeds a predetermined threshold, the rotational motion of the stem 14 will cause the teeth 92 to cam against the protrusions 86 forcing the protrusions 86 out of the grooves 96. This action provides clearance for the teeth 92 and stem 14 to rotate. There also is a sufficient gap between the housing 12 and the fingers 66 to enable the fingers 66 to flex as the short ribs 86 move in and out of the grooves 96.

Otherwise, when a rotational force is applied to the stem that does not exceed the predetermined threshold, the engagement between the teeth 92 and the short ribs 86 stay intact. That is, the fingers 66 will not cam and flex away from the longitudinal axis L and stem 14. Thus, the stem 14 is substantially locked in place.

This configuration reduces the amount of rotational force required to manually rotate the stem 14 because the fingers 66 are independent of the spring 38. For example, the fingers 86 are not squeezed between the spring 38 and the shoulder 52, which permits the fingers 66 greater flexibility to shift away from the stem 14 than a member so disposed.

For sprinkler 10, the predetermined threshold of force required to rotate the stem 14 manually is approximately 5 to 12 in-lbs (when pressurized water is not present), approximately 19 in-lbs (when water pressure is provided at a standard 45 psi), and approximately 25 in-lbs (when water pressure is provided at 75 psi, which is a typical maximum pressure for many rotary sprinklers). Table 1 below identifies the general appropriate torque values to manually rotate the stem 14 relative to the water pressure of the fluid in the housing 12.

TABLE 1

| WATER PRESSURE (PSI) | TORQUE (IN-LBS) |
|---|---|
| 7 | 12.71 |
| 10 | 13.14 |

TABLE 1-continued

| WATER PRESSURE (PSI) | TORQUE (IN-LBS) |
|---|---|
| 15 | 14.50 |
| 20 | 15.65 |
| 25 | 16.00 |
| 30 | 16.99 |
| 35 | 17.23 |
| 40 | 17.81 |
| 45 | 18.89 |
| 50 | 19.28 |
| 55 | 20.52 |
| 60 | 21.46 |
| 65 | 22.38 |
| 70 | 23.80 |
| 75 | 25.34 |

Figure 10:
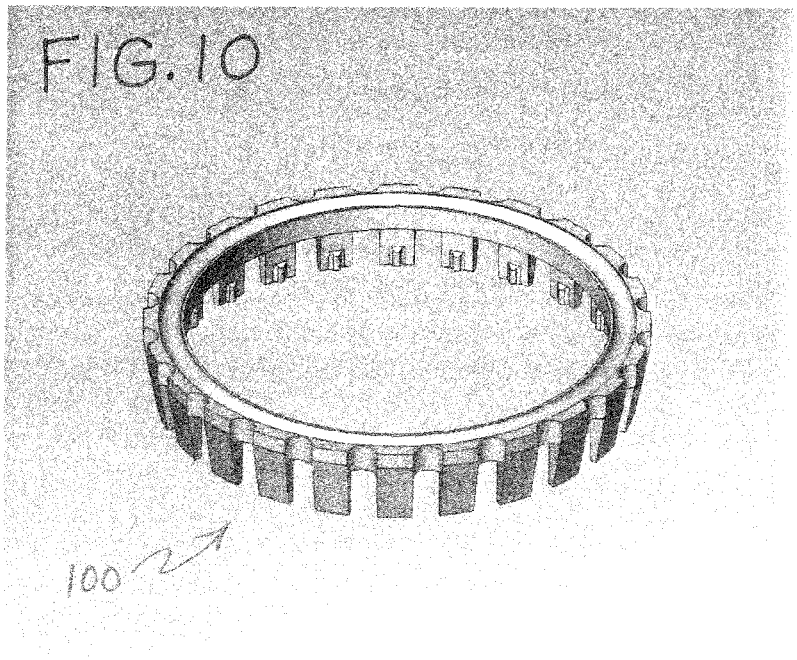
FIG. 10 is a perspective view of an alternative retainer embodying features in accordance with the present invention.

These torque values were obtained by reducing the amount of rotational force required to manually rotate the stem 14 with at least one guard 98 disposed between a portion of the spring 38 and a portion of the cylindrical outer surface 32 of the stem 14. This guard 98 limits the effect of the spring 38 on the rotation of the stem 14 by limiting the radial forces the spring 38 may impart on the stem 14. In one form, the guard 98 includes a sleeve that extends about at least a portion of the stem 14 and that has a sufficient stiffness to block or reduce at least some radial forces from the spring 38 from reaching the stem, particularly when the spring 38 is compressed because the stem 14 is in an extended state. The guard 98 has a diameter so that the guard slides axially along the stem. In one form, the guard 98 may be connected to or integrally formed with the retainer 34, as shown in FIGS. 2-5. Alternatively, as shown in FIG. 10, a retainer 100 may be separate from a guard or may not be associated with a guard. In yet other forms, the guard 98 may be longer or shorter which will change the amount of force a coil spring 38 exerts on the stem 14. Also, there may be more than one guard, such as guards stacked on top of each other on the stem or covering only certain circumferential sides of the stem.

Figure 11:
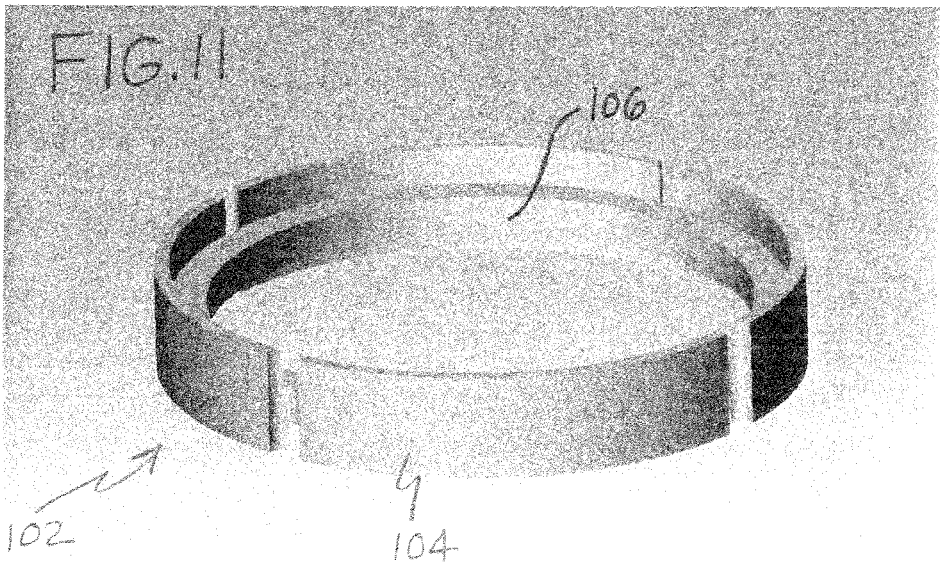
FIG. 11 is a perspective view of another alternative retainer embodying features in accordance with the present invention.

The resilient portion of a retainer may take on other forms rather than the fingers 66 of retainer 34. Thus, as shown on FIG. 11, an alternative retainer 102 may have flexible curved plates 104 that extend from a base portion 106 so that the plates 104 are not disposed between the spring 38 and the shoulder 52. The inner side of the plates 104 are then free to flexibly engage the teeth 92 on the outer surface 94 on the flange or shoulder 52 of the stem 14.

Figure 9:
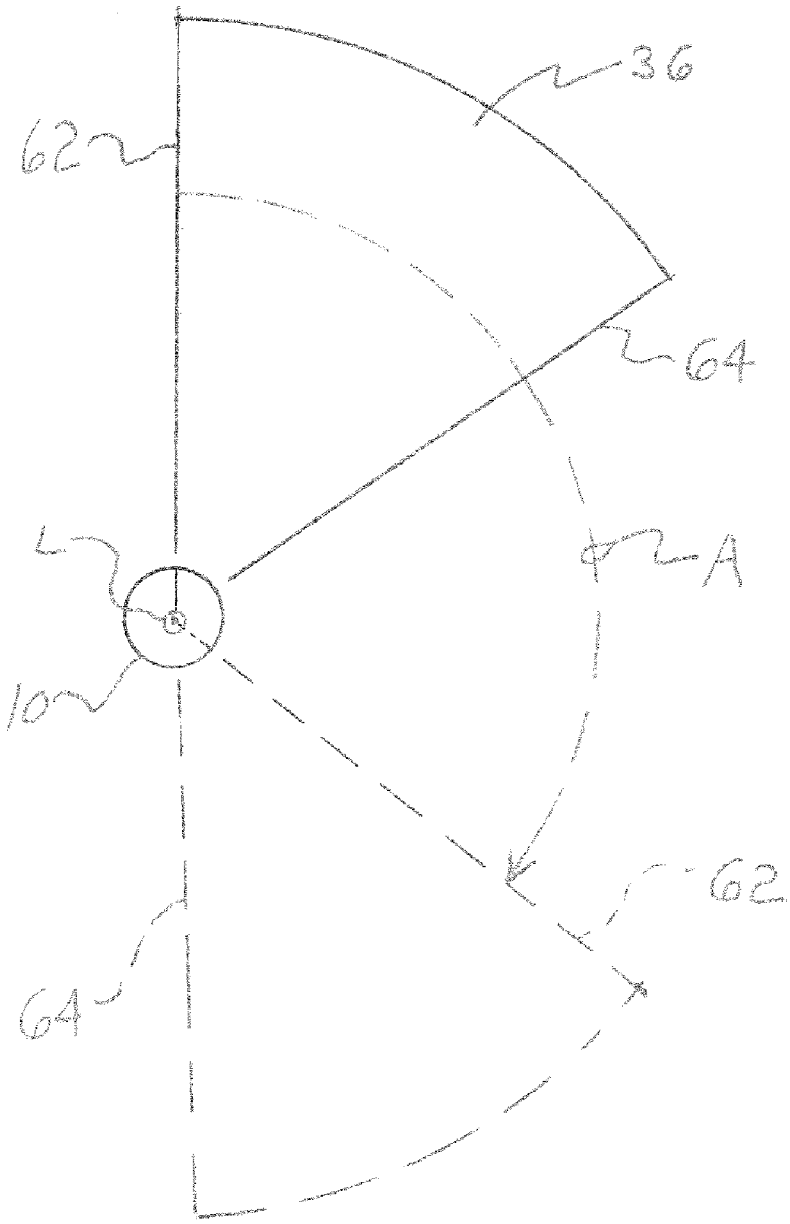
FIG. 9 is a diagram illustrating exemplary water spray arc patterns for the sprinkler of FIG. 1.

Referring to FIG. 9, with the configurations described above for an installed rotary sprinkler, the location of the spray arc 36 may be set as follows. First, the stem 14 must be moved to the extended position to expose the stem from the housing 12. This may be performed by operating the sprinkler so that sufficient water pressure forces the stem upward or by tools used to extend and hold the stem 14.

Once the stem 14 is exposed, the position of the fixed edge 62 of the spray arc 36 relative to the stem 14 is determined. This may simply require observing the rotary sprinkler and stem as the sprinkler is operating. In this case, the fixed edge 62 is located where the head 16 stops rotating in one direction, typically counterclockwise, and starts rotation back in the opposite direction. If the rotary sprinkler is not operating, the location of the fixed edge 62 may be determined by manually rotating the head 16 by hand until the user can feel that the head 16 has tripped the trip lever by a jump or vibration at the head. Otherwise, the usual angular location of the fixed edge 62 relative to the stem may be provided by indicia on the side of the stem.

After the location of the fixed edge 62 relative to the stem 14 is determined, a rotational force is applied to the stem, whether the sprinkler is operating or not, that is above a predetermined amount of force as described above. This causes the stem to rotate relative to the housing so that the fixed edge 62 may be placed in a desired angular position. The gear transmission of the sprinkler 10 may then be adjusted to set the second or adjustable edge 64 of the spray arc 36.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A sprinkler comprising:

a stationary portion configured for connection to a fluid source;

a head with an outlet for emitting fluid;

a stem supporting the head and configured for translating along a longitudinal axis and for rotating about the longitudinal axis; and at least one retainer disposed between the stationary portion and the stem and configured for permitting the stem to rotate about the longitudinal axis and relative to the stationary portion, and having a resilient portion of the retainer configured for flexing in a direction away from the longitudinal axis to provide clearance for the stem to rotate about the longitudinal axis and relative to the stationary portion.

2. The sprinkler of claim 1 wherein the retainer further comprises at least one base portion disposed adjacent the stem, and wherein the resilient portion includes at least one finger extending from the base portion and configured for engaging the stem.

3. The sprinkler of claim 2 wherein the base portion is annular and the at least one finger comprises a plurality of fingers extending from the base portion and being disposed at least generally around at least a portion of the stem.

4. The sprinkler of claim 2 wherein the stem further comprises a periphery with a plurality of teeth and each adjacent pair of teeth defining a groove therebetween, and wherein the at least one finger is configured to flex to move in and out of the groove and over the adjacent teeth when the rotational force exceeds the predetermined amount.

5. The sprinkler of claim 4 wherein each of the plurality of fingers includes at least one protrusion configured to extend into the groove between adjacent teeth.

6. The sprinkler of claim 2 wherein the at least one finger generally extends longitudinally relative to the longitudinal axis.

7. The sprinkler of claim 2 wherein the stem further comprises an outer surface, and wherein at least one finger has a free end that moves away from and toward the longitudinal axis as the at least one finger slides on the outer surface.

8. The sprinkler of claim 1 wherein the stem is configured so that rotating the stem about the longitudinal axis rotates the outlet on the head, and wherein the retainer and the stem are configured to cooperate to provide a plurality of discrete angular positions for the stem relative to the stationary portion.

9. A sprinkler comprising:

a stationary portion configured for connection to a fluid source;

a head with an outlet for emitting fluid;

a stem supporting the head and configured for translating along a longitudinal axis and for rotating about the longitudinal axis; and at least one retainer disposed between the stationary portion and the stem and configured for permitting the stem to rotate about the longitudinal axis and relative to the stationary portion, and having a resilient portion of the retainer configured for flexing in a direction to provide clearance for the stem to rotate about the longitudinal axis and relative to the stationary portion, wherein the stem is configured so that rotating the stem about the longitudinal axis rotates the outlet on the head, wherein the retainer and the stem are configured to cooperate to provide a plurality of discrete angular positions for the stem relative to the stationary portion, wherein the stem includes a plurality of teeth for engaging the at least one retainer, and wherein each tooth defines a discrete angular position of rotation for the stem about the longitudinal axis relative to the stationary portion when the rotational force applied to the stem exceeds a predetermined amount.

10. The sprinkler of claim 1 wherein the retainer is rotationally fixed relative to the stationary portion and is configured to translate along the longitudinal axis relative to the stationary portion.

11. The sprinkler of claim 10 further comprising a spring to bias the stem into the stationary portion and having a first end fixed axially relative to the stationary portion and a second end axially movable with the retainer.

12. A sprinkler comprising:

a stationary portion configured for connection to a fluid source;

a head with an outlet for emitting fluid;

a stem supporting the head and configured for translating along a longitudinal axis and for rotating about the longitudinal axis;

at least one retainer disposed between the stationary portion and the stem and configured for permitting the stem to rotate about the longitudinal axis and relative to the stationary portion, and having a resilient portion of the retainer configured for flexing in a direction to provide clearance for the stem to rotate about the longitudinal axis and relative to the stationary portion, wherein the retainer is rotationally fixed relative to the stationary portion and is configured to translate along the longitudinal axis relative to the stationary portion, wherein the stem further comprises at least one protrusion for engaging the retainer and resisting axial movement of the retainer along the longitudinal axis while permitting the stem to rotate relative to the retainer; and a spring to bias the stem into the stationary portion and having a first end fixed axially relative to the stationary portion and a second end axially movable with the retainer.

13. The sprinkler of claim 12 wherein the stem has an outer surface, and wherein the at least one protrusion includes at least one shoulder extending at least generally radially outward from the outer surface.

14. A sprinkler comprising:

a stationary portion configured for connection to a fluid source;

a head with an outlet for emitting fluid;

a stem supporting the head and configured for translating along a longitudinal axis and for rotating about the longitudinal axis;

at least one retainer disposed between the stationary portion and the stem and configured for permitting the stem to rotate about the longitudinal axis and relative to the stationary portion wherein the retainer is rotationally fixed relative to the stationary portion and is configured to translate along the longitudinal axis relative to the stationary portion;

a spring to bias the stem into the stationary portion and having a first end fixed axially relative to the stationary portion and a second end axially movable with the retainer; and at least one protrusion of the stem for engaging the retainer and resisting axial movement of the retainer along the longitudinal axis while permitting the stem to rotate relative to the retainer, wherein the retainer extends between the spring and the protrusion and further comprises a resilient portion configured for engaging the stem for permitting rotation of the stem when the rotational force exceeds the predetermined amount, and wherein the resilient portion is disposed other than between the spring and the protrusion.

15. The sprinkler of claim 12 further comprising a guard disposed between at least a portion of the spring and at least a portion of the stem to limit the affect of the spring on rotation of the stem.

16. The sprinkler of claim 15 wherein the guard comprises a sleeve extending over at least a portion of the stem.

17. The sprinkler of claim 15 wherein the guard is connected to the retainer.

18. A sprinkler comprising:

a stationary portion configured for connection to a fluid source;

a head with an outlet for emitting fluid;

a stem supporting the head and configured for translating along a longitudinal axis and for rotating about the longitudinal axis;

at least one retainer disposed between the stationary portion and the stem and configured for permitting the stem to rotate about the longitudinal axis and relative to the stationary portion wherein the retainer is rotationally fixed relative to the stationary portion and is configured to translate along the longitudinal axis relative to the stationary portion;

a resilient portion of the retainer configured for flexing in a direction away from the longitudinal axis to provide clearance for the stem to rotate about the longitudinal axis and relative to the stationary portion;

a spring to bias the stem into the stationary portion and having a first end fixed axially relative to the stationary portion and a second end axially movable with the retainer; and a guard disposed between at least a portion of the spring and at least a portion of the stem to limit the affect of the spring on rotation of the stem, wherein the guard is integrally formed with the retainer.

19. The sprinkler of claim 1 wherein the stem is permitted to rotate when a rotational force applied to the stem exceeds a predetermined amount of force that is at most approximately 25 in-lbs when the sprinkler is receiving pressurized fluid.

20. The sprinkler of claim 19 wherein the predetermined amount of force is approximately within the range of 5 to 12 in-lbs.

21. The sprinkler of claim 19 wherein the predetermined amount of force is approximately 19 in-lbs when the sprinkler is receiving fluid pressurized at about 45 psi.

22. The sprinkler of claim 19 wherein the predetermined amount of force is approximately 25 in-lbs when the sprinkler is receiving fluid pressurized at about 75 psi.

23. A sprinkler, comprising:

a stationary portion configured for connection to a fluid source;

a head with an outlet for emitting fluid;

a stem supporting the head and configured for translating along a longitudinal axis and rotating about the longitudinal axis;

at least one retainer having a resilient portion configured for engaging the stem to control rotation of the stem about the longitudinal axis;

a biasing member configured to bias the stem into the stationary portion and having a first end fixed axially relative to the stationary portion and a second end axially movable with the retainer, wherein the stem has a protrusion for supporting the retainer and extending beneath the second end of the biasing member, and wherein the resilient portion of the retainer is disposed other than between the second end and the protrusion.

24. The sprinkler of claim 23 wherein the resilient portion includes at least one finger configured to flex away from the longitudinal axis.

25. The sprinkler of claim 24 wherein the stem has an outer surface, and wherein the at least one finger has a free end that moves away from and toward the longitudinal axis as the at least one finger slides on the outer surface.

26. The sprinkler of claim 23 wherein the retainer is configured to permit the stem to rotate when the stem receives a rotational force that exceeds a predetermined amount.

27. The sprinkler of claim 23 further comprising a guard disposed between a portion of the biasing member and a portion of the stem to limit the affect the biasing member has on the rotation of the stem.

28. A sprinkler comprising:

a stationary portion configured for connection to a fluid source;

a rotatable head with an outlet for emitting fluid and configured for rotating though a spray arc defined between first and second edges;

a stem rotatably supporting the head and configured for translating along a longitudinal axis and rotating about the longitudinal axis, wherein the first edge of the spray arc is circumferentially fixed relative to the stem and the second edge is adjustable relative to the first edge so that rotating the stem rotates the position of the first edge to set the position of the spray arc; and a retainer disposed between the stationary portion and the stem and having a resilient portion of the retainer configured for flexing in a direction away from the longitudinal axis to provide clearance for the stem to rotate about the longitudinal axis and relative to the stationary portion.

29. The sprinkler of claim 28 wherein the retainer is configured to limit rotation of the stem unless a rotational force on the stem exceeds a predetermined amount.

* * * * *

UNITED STATES PATENT AND TRADEMARK OFFICE

CERTIFICATE OF CORRECTION

PATENT NO. : 7,686,236 B2
APPLICATION NO. : 11/689135
DATED : March 30, 2010
INVENTOR(S) : Mona-Lisa Alexander It is certified that error appears in the above-identified patent and that said Letters Patent is hereby corrected as shown below:

IN THE CLAIMS

Column 11, line 14, in claim 23, after “the” and before “retainer” insert --at least one--.

Column 11, line 15, in claim 23, after “has” delete “a” and insert --at least one-- therefor.

Column 11, line 16, in claim 23, before “retainer” insert --at least one--.

Column 11, line 18, in claim 23, after “the”, second occurrence, and before “retainer” insert --at least one--.

Column 11, line 19, in claim 23, after “the”, second occurrence, and before “protrusion” insert --at least one--.

Column 11, line 27, in claim 26, after “the”, second occurrence, and before “retainer” insert --at least one--.

Column 12, line 1, in claim 27, after “comprising” delete “a” and insert --at least one-- therefor.

Column 12, line 9, in claim 28, delete “though” and insert --through-- therefor.

Signed and Sealed this
Fifth Day of May, 2015

Michelle K. Lee

Michelle K. Lee
*Director of the United States Patent and Trademark Office*